US011925853B1

(12) United States Patent
Govoni et al.

(10) Patent No.: US 11,925,853 B1
(45) Date of Patent: Mar. 12, 2024

(54) BOWLING GAME, RELATED SYSTEMS AND METHODS OF PLAYING

(71) Applicant: QUBICAAMF EUROPE S.P.A., Bologna (IT)

(72) Inventors: Emanuele Govoni, San Matteo della Decima (IT); Roberto Vaioli, Ozzano dell'Emilia (IT); Ivano Noferini, San Lazzaro di Savena (IT)

(73) Assignee: QUBICAAMF EUROPE S.P.A., Bologna (IT)

( * ) Notice: Subject to any disclaimer, the term of this patent is extended or adjusted under 35 U.S.C. 154(b) by 0 days.

(21) Appl. No.: 14/971,336

(22) Filed: Dec. 16, 2015

Related U.S. Application Data

(60) Provisional application No. 62/092,607, filed on Dec. 16, 2014.

(51) Int. Cl.
*A63D 5/04* (2006.01)
*A63D 1/00* (2006.01)

(52) U.S. Cl.
CPC ..... *A63D 5/04* (2013.01); *A63D 1/00* (2013.01); *A63D 2005/042* (2013.01); *A63D 2005/044* (2013.01)

(58) Field of Classification Search
CPC ..... A63D 5/04; A63D 2005/003; A63D 2005/042; A63D 3/00
USPC ..... 473/55, 113, 115
See application file for complete search history.

(56) References Cited

U.S. PATENT DOCUMENTS 2,316,991 A * 4/1943 Seaman ..... A63D 5/04 473/67
2,931,656 A * 4/1960 Hooker ..... A63F 7/0058 273/118 A
3,082,000 A * 3/1963 Holcombe ..... A63D 5/00 273/127 R (Continued)

FOREIGN PATENT DOCUMENTS

EP 0652797 A1 5/1995
EP 1513595 A1 3/2005

OTHER PUBLICATIONS

Types of Sensors for Target Detection and Tracking, https://www.intorobotics.com/types-sensors-target-detection-tracking/, Nov. 2013.*

(Continued)

*Primary Examiner* — William M Pierce
(74) *Attorney, Agent, or Firm* — Andrew M. Calderon; Calderon Safran & Cole, P.C.

(57) ABSTRACT

The present disclosure relates to bowling center systems and, more particularly, to bowling games, bowling systems and equipment used in a bowling center, for example. The bowling system, includes: one or more non-contact sensors which are configured to detect a position of a bowling ball as it is rolling down a bowling lane; a lighting system configured to light predetermined locations within a bowling centre in predetermined arrangements; and an electronic control system which receives signals from the one or more non-contact sensors, determines a position of the bowling ball on the bowling lane and provides signals to the lighting system to light the predetermined locations within the bowling centre in the predetermined arrangements.

25 Claims, 5 Drawing Sheets

(56) References Cited

U.S. PATENT DOCUMENTS 3,145,025 A * 8/1964 Morrison ..... A63D 5/04 473/67
3,252,705 A * 5/1966 Cornberg ..... A63D 5/04 473/58
4,247,100 A * 1/1981 Barbee ..... A63D 5/04 473/58
4,893,182 A * 1/1990 Gautraud ..... G01S 3/7865 348/579
5,071,127 A * 12/1991 Bromley ..... A63F 7/0005 194/344
5,118,105 A * 6/1992 Brim ..... A63D 5/08 473/58
5,241,379 A * 8/1993 Tsujita ..... H04N 7/183 340/323 B
5,449,326 A * 9/1995 File ..... A63D 1/00 473/113
5,584,766 A 12/1996 File
5,599,236 A 2/1997 File
5,626,523 A 5/1997 Mowers et al.
5,800,274 A * 9/1998 Widrick ..... A63D 5/00 473/113
5,846,138 A * 12/1998 Borden ..... A63D 1/00 273/DIG. 24
5,882,263 A * 3/1999 Chung ..... A63D 5/04 348/E5.137
5,888,142 A * 3/1999 Perrier ..... A63D 1/04 273/DIG. 24
6,031,343 A * 2/2000 Recknagel ..... A63D 1/08 315/292
6,077,167 A * 6/2000 Ciniello ..... A63D 5/04 473/54
6,110,052 A * 8/2000 Sprager ..... A63D 5/04 340/323 B
6,319,142 B1 11/2001 Ciniello
7,025,687 B2 * 4/2006 Bouchard ..... A63D 5/04 473/115
7,708,647 B2 * 5/2010 Connell ..... A63D 5/00 362/217.01
8,088,017 B2 1/2012 Stremmel et al.
8,292,733 B2 10/2012 Crawford et al.
11,607,603 B2 3/2023 Govoni et al.
2002/0047646 A1 4/2002 Lys et al.
2004/0242292 A1 12/2004 Hansen
2005/0014570 A1 1/2005 Blackstone
2005/0037853 A1 * 2/2005 Brim ..... A63D 1/04 473/115
2005/0063194 A1 3/2005 Lys et al.
2005/0096142 A1 * 5/2005 Saunier ..... A63D 1/00 473/115
2005/0288116 A1 * 12/2005 Chen ..... A63D 5/00 473/113
2005/0288117 A1 * 12/2005 Chen ..... A63D 1/08 473/113
2006/0022214 A1 * 2/2006 Morgan ..... F21K 9/00 257/99
2007/0184908 A1 8/2007 Hansen
2008/0287204 A1 11/2008 Stremmel et al.
2009/0270193 A1 10/2009 Stremmel et al.
2011/0053688 A1 3/2011 Crawford et al.
2011/0301726 A1 * 12/2011 Colquitt, Sr. ..... A63D 5/04 700/91
2013/0237334 A1 9/2013 Meigs et al.
2013/0324272 A1 * 12/2013 Vaioli ..... A63D 5/04 473/70
2015/0367227 A1 * 12/2015 Vaioli ..... A63D 5/04 345/619

OTHER PUBLICATIONS

The Internet Pinball Machine Database Gossary, https://web.archive.org/web/20110501191810/https://www.ipdb.org/glossary.php, May 2011.*
Crunchy Tech, Unreal Bowling, https://crunchytech.com/products/unreal-bowling/, Jan. 2022, 6 pages.
Qubica AMF, Hyper Bowling, HyperBump, https://www.qubicaamf.com/bowling-products/scoring-management-systems/hyperbowling/technology, Jun. 2020, 6 pages.
International Search Report in related International Application No. PCT/IB2018/055105 dated Jan. 17, 2019, 3 pages.
Written Opinion in related International Application No. PCT/IB2018/055105 dated Jan. 17, 2019, 5 pages.

* cited by examiner

BOWLING GAME, RELATED SYSTEMS AND METHODS OF PLAYING

BACKGROUND OF THE INVENTION

1. Field of the Invention

The present disclosure relates to bowling center systems and, more particularly, to bowling games, bowling systems and equipment used in a bowling center, for example.

2. Discussion of Background Information

The game of bowling is enjoyed by millions of people around the world. With new technologies, the game of bowling has been made easier for bowlers, resulting in a more enjoyable experience. For example, technologies have introduced scoring systems, which will automatically score the bowling game, taking this task away from the bowlers themselves.

SUMMARY OF THE INVENTION

In an aspect of the invention, a bowling system includes: one or more non-contact sensors which are configured to detect a position of a bowling ball as it is rolling down a bowling lane; a lighting system configured to light predetermined locations within a bowling centre in predetermined arrangements; and an electronic control system which receives signals from the one or more non-contact sensors, determines a position of the bowling ball on the bowling lane and provides signals to the lighting system to light the predetermined locations within the bowling centre in the predetermined arrangements.

In embodiments, the electronic control system provides signals to the lighting system to provide lighting effects tracking the bowling ball as it rolls down the bowling lane. The one or more non-contact sensors comprises a camera, which may include infra-red capabilities. The one or more non-contact sensors can also be ultrasound sensors, microwave radar or optical sensors. The optical sensors detect the bowling ball breaking a light beam or an array of light beams and the electronic control system uses the breaking of the at least one light beam to calculate a position of the bowling ball. The non-contact sensors can also detect the position of the bowling ball when it contacts bumpers. The bowling system further comprises contact sensors provided on bumpers to determine a contact location of the bowling ball on the bumpers, in conjunction with the electronic control system. Also, the lighting system can segment bumpers into a plurality of logical bumper segments, or the bumpers can be multiple physical bumpers along sides of the bowling lane. The predetermined locations within the bowling centre comprise any combination of the bowling lane, portions of the bowling lane, and adjacent areas linked to the bowling lane. The adjacent areas linked to the bowling lane can include in any combination gutters, pit lights and approach area.

In yet further embodiments, the bowling system includes: one or more sensors arranged along a bowling lane and which are configured to track a position of a bowling ball as it is rolling down the bowling lane; a lighting system configured to light the bowling lane in predetermined arrangements tracking the bowling ball as it rolls down the bowling lane, as the bowling ball is tracked by the one or more sensors; and an electronic control system which receives signals from the one or more sensors, determines a position of the bowling ball on the bowling lane and provides signals to a lighting system control which provides controls to the lighting system to light the bowling lane as it is tracked.

BRIEF DESCRIPTION OF THE DRAWINGS

These and other innovative aspects, or advantageous features are set out in the appended claims and the technical features and advantages of the invention are apparent from the detailed description which follows of preferred embodiments of it, to be considered purely as non-limiting examples. The description is made with reference to the accompanying drawings, in which:

DETAILED DESCRIPTION OF THE INVENTION

Figure 1:
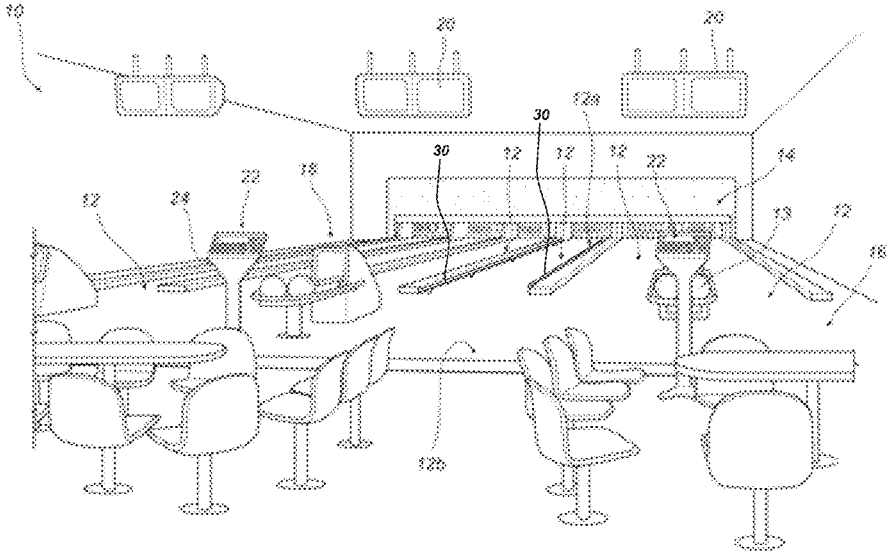
FIG. 1 shows a schematic representation of a bowling center in accordance with aspects of the present invention.

The present invention relates to bowling center systems and, more particularly, to bowling games, bowling systems and equipment used in a bowling center, for example. More specifically, the present invention creates a new bowling format converting, in a non-permanent way, existing bowling lanes, systems and equipment of a bowling center in order to extend the reach of bowling to people looking to have fun in a non-competitive or fun environment. These systems and equipment include, for example, control systems (e.g., scoring systems, etc.), lighting systems, sensors, non-standard pins and bowling balls, in any combination.

For example and by way of non-limiting illustration, the systems and equipment include, in any combination:

(i) Lighter, easier to grab and handle bowling balls (e.g., same size, lighter, number of holes or handling structure might vary);

(ii) Lighter pins (e.g., non-standard pins) which are easier to knock down and designed to work with the lighter ball;

(iii) Intelligent bumpers which have sensors to determine a location of a bowling ball hit on the bumper, for example;

(iv) Sensors to track movement of the bowling balls in the bowling lane or on the pin deck;

(v) Lighting systems which can track the bowling ball or provide other forms of entertainment (e.g., lighting responses) in response to a ball roll on the bowling lane or the ball touching the bumpers;

(vii) Bowling balls that lights up; and/or (viii) Exciters connected to the scoring system.

By way of even more specific examples, the bowling lanes, systems and equipment of the bowling center can feature pin deck lighting to light up pins in certain situations, e.g., after the bowling ball hits a predetermined zone of the bumper. The lighting can also be provided in other areas over or on the lane in order to track the movement of the ball with lighting arrangements, as the bowling ball rolls down the bowling lane. The bowling balls can also light up or the pins can light up with the same or different colors, depending on the position of the ball, speed of the ball, etc., as detected by the detection system (e.g., sensors, cameras, etc). In further embodiments, the bumpers can be split into different zones, e.g., three zones, where each zone lights up in a different color, as an example. These and other games can be under the control of the electronic control system, which provides instructions (e.g., signals) to the lighting systems, scoring systems, etc., in order to effectuate the different effects described herein.

In additional embodiments, the systems and equipment described herein can include non-contact sensors which detect where the ball is on the bowling lane even without contacting the bumpers. For example, the sensor can pick up the ball position even when running in the lane. These sensors can be, e.g., camera, ultrasound, microwave radar or optical sensor as described further herein. Accordingly, this allows for using the ball position to enhance the light effect that can run by the light system. Specifically, the light effect can "follow" the ball while the ball is rolling down the lane as an example.

The bowling systems and equipment described herein can thus be used for different types of bowling game, e.g., players have to hit different zones of the bumpers, before they hit the pins. These games can include two or more bowling balls, different amounts of pins, e.g., less than 10 pins, pins that are repositioned after a ball throw, e.g., pins left from the previous ball could be re-positioned and maintaining dead pins, e.g., dead pins are not swiped, to make it easier to knock down pins after the second ball, each of which is controllable by the electronic control system. For example, the electronic control system will direct the sweep to be inactive or the pinsetter to reset pins in a different position in accordance with aspects of the invention. According, each of these different games can be controlled by the electronic control system as described herein, including the different lighting effects, tracking of the bowling balls, etc.

These games and any of the systems, methods and equipment described herein can be used with a scoring system, e.g., BES X scoring system manufactured by QubicaAMF. The scoring system can be representative of computer devices described in FIG. 2 or 3, for example. Advantageously, none of the different effects described herein are permanent and, as such, the bowling center can revert back to the traditional bowling game by switching pins and balls and setting the electronic control systems to conventional bowling game play, e.g., default settings.

In further embodiments, the bumpers provided herein have several advantageous attributes including, e.g., (i) stronger constructions to support intentional hits from bowling balls;

(ii) the ability to have different segments raised or lowered, manually or automatically;

(iii) sensors to detect where contact of a bowling ball is made for use in various games described herein. In embodiments, there will be sufficient numbers of sensors (e.g., four sensors) to be able to break the bumpers up into zones of variable lengths from small (e.g., a meter or less) to large (e.g., the entire lane). These sensors, e.g., sensor 504 shown in FIG. 5, can detect where the bowling ball is on the lane even without contact; and (iv) lights running the length of the bumper, which are controllable and connected to the scoring and the game controllers (e.g., electronic control system). The lights, e.g., lights 503 shown in FIG. 5, can be used for several purposes including, e.g., for targeting locations to hit or avoid along the bumper length, tracking of the ball as it rolls down the bowling lane, etc. The lighting can be used in conjunction with ball position on the bowling lane (e.g., lights follow the ball as it rolls towards the pins, in conjunction with the sensors noted herein).

Scoring and Management System

FIG. 1 illustrates a bowling center or bowling alley 10 which comprises one or more bowling lanes 12 along which a bowling ball 13 is rolled. In embodiments, the bowling ball 13 is shown at the end of the lane where the bowling balls 13 are collected by a device 18, e.g., ball return mechanism, which returns the bowling balls 13 to the throwing zone. The bowling center 10 also comprises a pin setting up machine 14, e.g., pinspotter, at one end 12*a* of the bowling lane 12 and bowlers' bay 16 at the opposite end 12*b* of the bowling lane 12. The device 18, e.g., ball return mechanism, and pin setting up machine 14 are conventional systems in the bowling center such that no further discussion is needed in order for one of skill in the art to understand the present disclosure. These mechanisms can be controlled by the electronic control system, e.g., scoring system, as should be understood by those of skill in the art such that no further explanation is required.

The bowling center 10 also comprises bumpers 30 along sides of the bowling lanes 12. The bumpers 30 are optional, but a preferred embodiment of the present invention. For example, the bumpers 30, when activated, allow bowlers to play a bowling game avoiding the possibility of the bowling ball 13 falling in the lane gutter. The bumpers 30 can be a single bumper or multiple bumpers along an entirety of each side of the bowling lane 12.

In embodiments, the bumpers 30 and related mechanism are strong enough to support intentional hits from regular sized bowling balls thrown with full force by adult bowlers. The bumpers 30 can either be a single segment, it can be made of different segments, or can be divided in more segments only logically, using lights to highlight the active bumper section. If the bumpers 30 are made of one or more segments, each segment can be controlled (raised, lowered, moved, highlighted by lights) independently from the other ones. Each segment can be equipped with independent and distinct sensors (sensor 504*a*-504*d* shown in FIG. 4) to monitor the impact zones of the bumper 30, to detect if the segment has been hit by a bowling ball 13 or to detect the position of the bowling ball 13 along the lane; it can alternatively be equipped by a single bumper-long sensor (sensor 504 shown in FIG. 5) that is able to obtain the absolute position the ball hit, or by other types of sensors achieving the same effect, such as a camera overlooking the lane and identifying the hitting positions of the bowling balls 13 on both right and left bumpers 30 and the ball position and path on the lane, even in case of no bumper hits, by means of automated image recognition.

Figure 2:
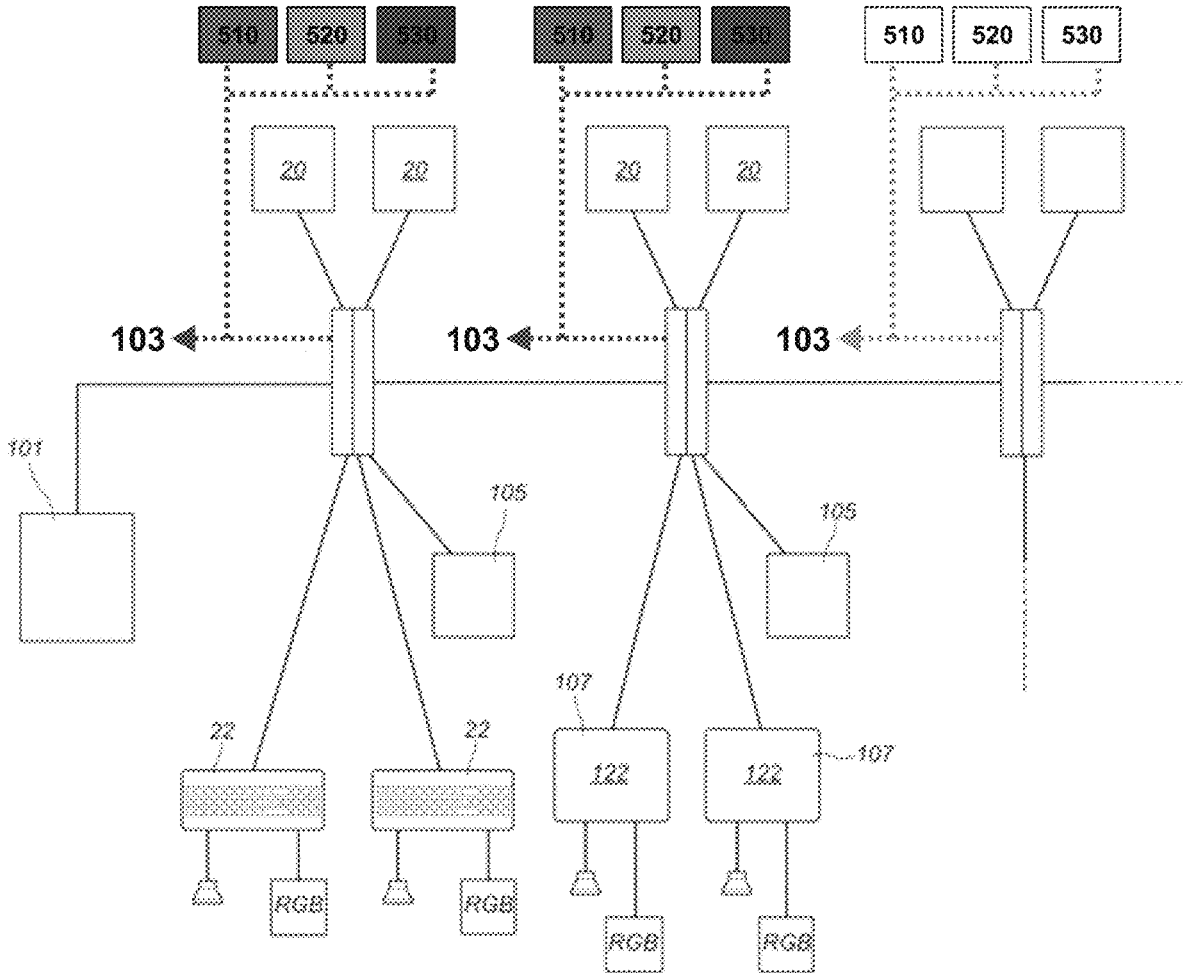
FIG. 2 shows an electronic control system in accordance with aspects of the present invention.
Figure 3:
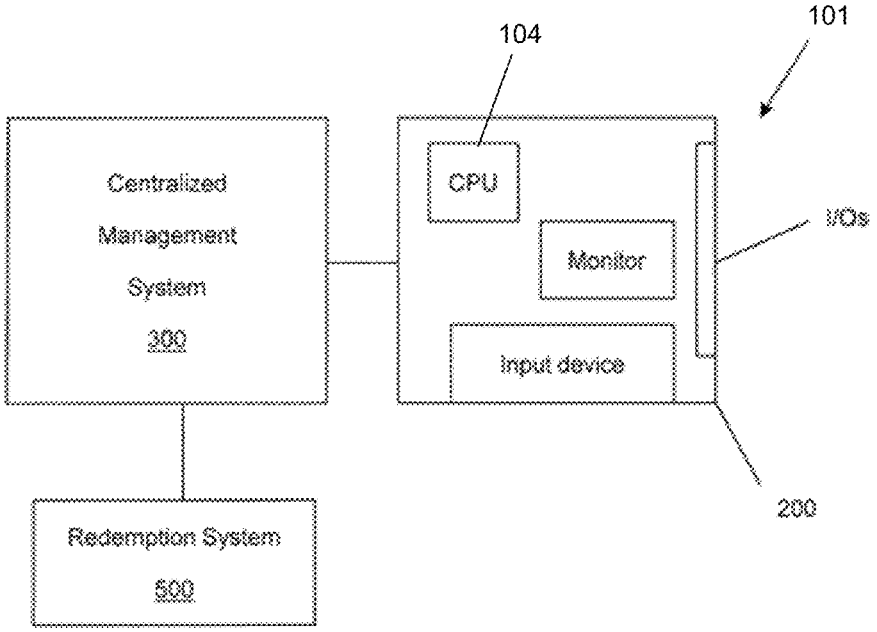
FIG. 3 shows a representative computer infrastructure, which can be representative of a bowling scoring and/or management system, electronic control system or other computer device used in a bowling center for scoring and/or management of games in accordance with aspects of the present invention.

Each of the one or more segments of the bumper 30 can be controlled manually, by a dedicated automated or semi-automated system, by the scoring system or by the management system (e.g., as described in FIGS. 2 and 3). For example, as described herein, each of these systems can send the bumper instructions for single movements or for light highlighting, with the result of having predetermined combination of movements or highlighting, dynamically determined combination of movements or highlighting (for example determined by a predetermined game instruction or reacting to ball hits or other external events). Each of the one or more bumper segments can also be manually controlled for movement or highlighting.

As illustrated further in FIG. 1, the bowling center 10 further comprises overhead monitors or videos 20 above the bowling lane 12, and a number of consoles 22 located at the one or more bowling lanes 12, respectively, which allow a user to enter data and commands. In embodiments, the camera can be represented by reference numeral 20 of FIG. 1, as shown above the bowling lane and positioned to view the bowling lane and more specifically the bowling ball as it rolls down the bowling lane. In embodiments, the camera can be placed at other locations. In embodiments, preferably, each console 22 in the bowling center 10 is mounted on a respective stand 24. The bowling center 10 also comprises an electronic control system (see, e.g., FIGS. 2 and 3) which is set up to manage the bowling center, and in particular, the score program, that is, the program which calculates the score of the games played at the bowling center and displays that score, in particular at the respective overhead monitors 20. The electronic control system (e.g., main electronic processor 101 or local or lane electronic processor 103 of FIG. 2) can manage the lighting, sensors, game play, tracking of the bowling balls, etc. as described herein.

FIG. 2 shows the electronic control system in accordance with aspects of the present invention. More specifically, the electronic control system comprises a main electronic processor 101, in particular in the form of a Windows PC, in communication with a plurality of local electronic processors 103 at the bowling lanes, in particular in the form of Linux PCs, which are in turn connected to mechanism which controls the pin setting up machine and to the lane consoles 122, 122, in particular to the mechanism 107 for controlling the same. It should be understood by those of ordinary skill in the art that other operating systems are contemplated herein, and that the operating systems of the electronic control system described herein should not be considered a limiting feature of the present invention. In embodiments, each local electronic processor or lane processor 103 is connected to the respective overhead monitor 20.

Still referring to FIG. 2, the main electronic processor 101 implements the management system program in a known manner using the data received from each electronic lane processor 103 to record and process each of the games played at the bowling center, providing support for the center operations as described herein. Also, the local electronic processor or lane processor 103 is set up to control and manage the score program and displays that score at the respective overhead monitor 20. For example, in practice, the local or lane electronic processor 103 is configured to directly implement the game score and to display it on the corresponding overhead monitor 20 and/or on the lane monitor 122. In practice, the electronic control system comprises, at the bowlers' bay, in particular at the lane console, an electronic processor 122 which can implement software functions and applications independently of the main processor 101 and of the lane or local processors 103.

The local or lane electronic processor 103 (e.g., Lane-Score-Computer) is a computerized system that manages games on a single or multiple lanes. The example described herein assumes one pair of lanes; although other configurations are also contemplated by the present invention. In embodiments, the Lane-Score-Computer 103 is connected to a sensor control unit 510, an actuator control unit 520, and a light control unit 530. As should be understood by those of skill in the art and as further described herein, through the use of local or lane electronic processor 103 and/or more generally the electronic control systems described herein (e.g., main electronic processor 101) can manage the lighting, sensors, game play, tracking of the bowling balls, etc. as described herein. For example, by processes controlled by the main electronic processor 101 or local or lane electronic processor 103*m*, the actuator control unit 520 will control actuators, the sensor control unit 510 connects to sensors (e.g., sensor 504) for determining the location of a bowling ball as it hits the bumper or rolls down the bowling lane, for example, and the light control unit 530 will manage the lighting within the bowling center as described further herein. More specifically, in embodiments, the electronic control system (which is generally used to describe the processors herein) receives signals from the sensors and, in response, can provide signals to any of the actuator control unit 520, and light control unit 530 to control the respective actuators and lighting system, based on, for example, the position of the bowling ball as detected by the sensors.

In embodiments, the scoring system (and other control systems described herein) includes a main CPU that is connected to:

- A local monitor (typically overhead display monitor above the lane);
- I/O devices to interface with the pinspotting machines;
- I/O devices to collect information regarding when a ball is thrown, how many pins have fallen, if a foul has been detected, and other information available on the lane about the ball that was bowled; and
- I/O console device (keypad, LCD, or similar) to allow the scoring system to interact locally on the lane with the bowlers.

FIG. 3 shows a representative computer infrastructure, which can be representative of a bowling scoring and/or management system, electronic control system or other computer device used in a bowling center for scoring and/or management of games in accordance with aspects of the present invention. In embodiments, the centralized management system 300 is a computerized system comprising one or more computers 101 located at the counters and back office of the bowling center. In embodiments, the system allows the manager/employees of the bowling center to manage the customers from check-in to check-out. One of the main functions performed by the management system is to send the necessary information to set up the Lane-Score-Computer 103, which then takes care of the game being bowled on the bowling lane. At the end of the game the management system collects the necessary information from the Lane-Score-Computer 103 in order to manage the game scores, rankings, payments, etc. The centralized management system 300 can control/manage any of the features of the present invention.

Illustratively, the computer infrastructure can be representative of either the Lane-Score-Computer 200 (also represented as local or lane electronic processor 103 of FIG. 2) or centralized management system 300 or other processors described herein. For example, the processes herein provide a means to communicate with the different components and/or equipment by way of electronic signals in order to control the lighting systems and actuators based on signals received from the sensors, detecting the position of a bowling ball as it is rolling down the bowling lane. In embodiments, the processors, e.g., centralized management system 300 or other computer system provided in the infrastructure, can receive the signals received from the sensors, e.g., sensor control unit 510, and use these signals to determine a position of the bowling ball within the bowling lane, and then coordinate with the lighting system, e.g., light control unit 530, to control the lighting system, based on, for example, the position of the bowling ball as detected by the sensors. To this extent, the computer infrastructure includes a server or other computing system that can perform the processes described herein. The server and/or computing device can communicate over any communication link such as an intranet, LAN, WAN, Internet, etc. The computing device can be resident on a network infrastructure or computing device of a third party service provider.

As should be understood by those of skill in the art, the Lane-Score-Computer 200 or centralized management system 300 or a redemption system 500 or other processors described herein can be implemented as computing device, such as a sever. For example, any of the processors, e.g., processor 101, 103, 122, or other computing systems described herein, can equally be represented as the computing device.

In any of the embodiments, for example, the computing device includes a processor (CPU 104), memory, an I/O interface, and a bus. In addition, the computing device includes random access memory (RAM), a read-only memory (ROM), and an operating system (O/S). The computing device is in communication with the external I/O device/resource and the storage system. The I/O device can comprise any device that enables an individual to interact with the computing device (e.g., user interface) or any device that enables the computing device to communicate with one or more other computing devices using any type of communications link. The external I/O device/resource may be for example, a handheld device, tablet, smartphone, PDA, handset, keyboard, a system converting sounds into electrical signals sent to the scoring or management system and generating a relevant event used to trigger a special effect, etc.

In general, the processor executes computer program code (e.g., program control), which can be stored in the memory and/or storage system. The program control provides the processes described herein. The program control can be implemented as one or more program code stored in memory as separate or combined modules. Additionally, the program control may be implemented as separate dedicated processors or a single or several processors to provide the function of these tools. While executing the computer program code, the processor can read and/or write data to/from memory, storage system, and/or I/O interface. The bus provides a communications link between each of the components in the computing device.

As will be appreciated by one skilled in the art, the program code can be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects. Furthermore, aspects of the present invention may take the form of a computer program product embodied in one or more computer readable storage medium(s) having computer readable program code embodied thereon. Any combination of one or more computer readable storage medium(s) may be utilized. A computer readable storage medium is non-transitory, e.g., is not a signal per se. The computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device. The computer readable storage medium is not a signal per se. The computer readable storage medium is non-transitory.

Games for Bowling Centers Based on Systems Described Herein

In known bowling games, the bumpers are there to avoid the ball going into the gutter, i.e., the current purpose of a bumper is to keep the ball on the lane, to avoid bowlers disappointment and increase the chances of striking down pins. The bumpers can temporarily be activated in a lane (they are manually or automatically lifted) so that a bowler can decide to bowl with or without them.

In accordance with aspects of the invention and to add a new dimension to the bowling lane, lane sides, physically represented by the bumpers, can be active and interactive elements of the bowling game. For example, the lane sides would lose their current role of being just containing borders determining if the player's ball remains in the game or not, but they are now an active part of the game, contributing to the scoring or to any other non-scoring outcome. This is done through the use of sensors and lighting systems, for example, as described herein. By way of example, the bowler would be asked to hit the bumper or one of its portions to achieve a better score, which would be sensed by the sensor and provided to the contact sensor control unit 510. In alternative games, the bowler could be asked not to hit the bumpers, or one or more of its sections, to avoid obtaining a penalty.

In embodiments, even if the bumpers are raised, the standard tenpin bowling game can still be played, assuming that when the bumper gets touched, the score will end up being the same as standard bowling. Although this is not a USBC/BPAA/PBA allowed rule, unsanctioned competitions can implement such a scheme in 10-pin standard mode even if the bumper is raised.

Referring now to FIGS. 1-4, in embodiments, the bumpers 30 can be raised or lowered, on any or both of the two sides of the bowling lane 12, simultaneously or separately. For example, the bumpers 30 can be raised completely if built as a single element lane-long element or partially if built as separate sections, in order to highlight which bumper 30, or bumper section, the player has to hit in order to score more points, or which section must not be hit to avoid penalties. Also, in embodiments, the bumper 30, whether built as single elements or composed of different sections along the lane, can be completely raised along the length of the lane, with the specific one or more sections to hit or not to hit highlighted by the lighting system as described herein. For example, the electronic control system shown in FIGS. 2 and 3 can be used to control lights to target certain sections of the bumpers 30.

In embodiments, and as described herein, the bumper 30 could be equipped with sensors (e.g., sensors 504*a*-504*d* in FIG. 4) to detect the bowling ball 13 hitting the whole bumper 30 or one or more of its sections. In more specific embodiments, the bumper 30 could be equipped with sensors (e.g., sensors 504*a*-504*d* in FIG. 4) to detect the absolute position of the ball hitting the whole bumper 30 or one or more of its sections. The one or more sensors (e.g., sensors 504*a*-504*d* in FIG. 4) on the one or more bumpers 30 on the one or more bowling lanes make up a detection system that can provide a set of one or more inputs directly, or through a dedicated processing device for additional signal processing, to one or more of the lane pinspotting machines, the scoring system, the management system, or to another system or device such as special effects devices or a special effects management system as described herein. All these systems can be either physically present at the bowling center or located remotely, as a management system described with respect to FIGS. 1-3, operating off the premises such as a cloud-based system.

Figure 4:
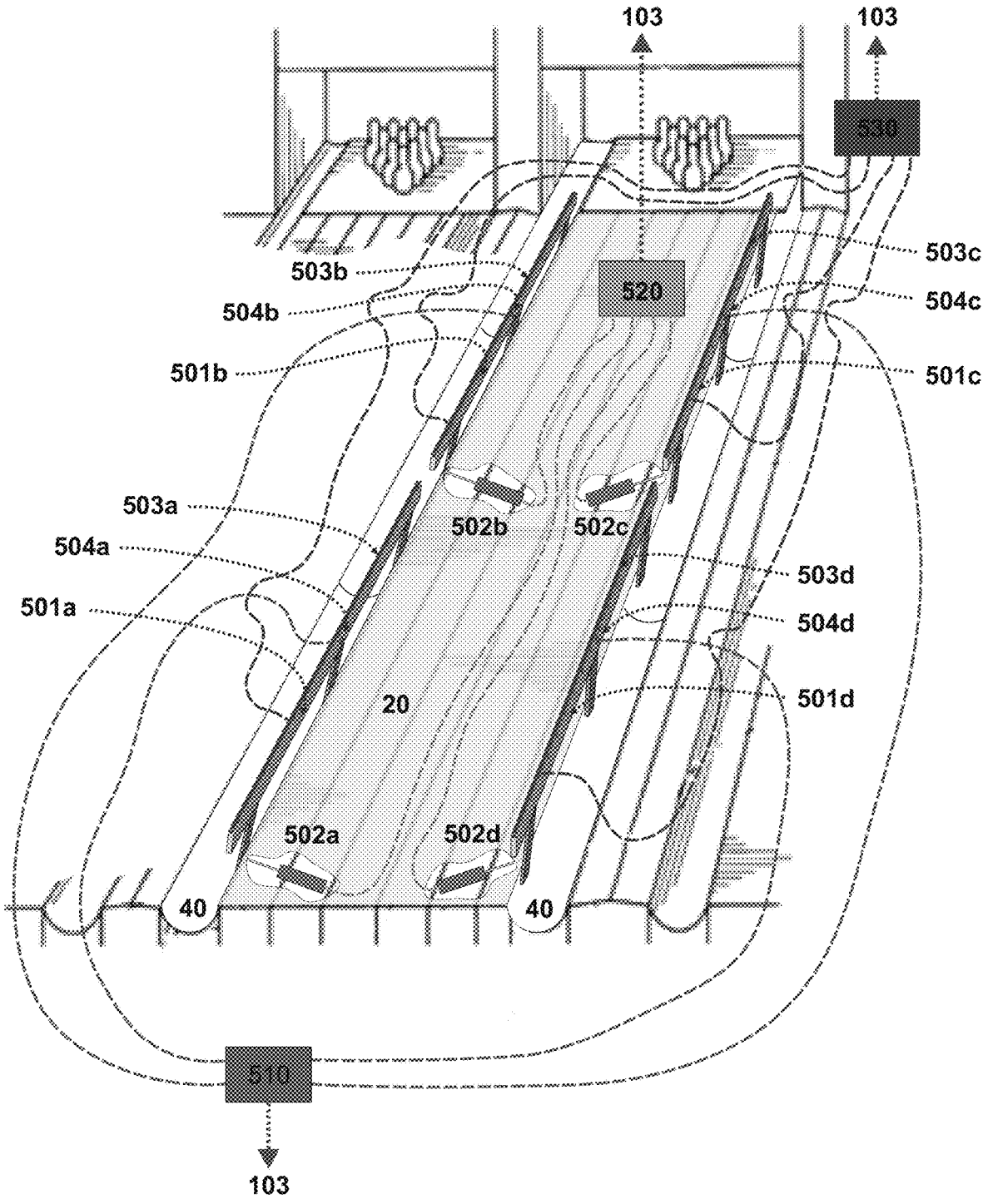
FIG. 4 shows an exemplary implementation of the systems and processes in accordance with aspects of the present invention.

In embodiments, the detection system (e.g., sensors 504*a*-504*d* connected to and managed by a contact sensor control unit 510 in combination with the computing device shown in FIGS. 3 and 4) can be connected to an automated scoring system to have the score calculated and the game run automatically also accordingly the signals provided by the sensors, as represented in the combination of FIGS. 1-3. Also the system highlighting which bumper or bumper section to hit can be connected to an automated scoring system.

In case of a bowling lane being equipped with sensors 504*a*-504*d*, as shown in FIG. 4, which detect the ball hits along the lane border, such a lane could be built without any of gutters, bumpers or foul line detector, and be still used to play all the above-mentioned games, including a standard tenpin game. In this case, the following examples can be implemented by the systems and processes described herein.

- The sensors 504*a*-504*d* would provide the pinspotter machine and/or the scoring with the information about the ball touching the lane limits, detecting the cases when the ball would have fallen in the gutter 40 if the lane were built in a standard way with gutters 40.
- The scoring would entirely manage the game as previously described, including in a tenpin bowling standard rules emulation mode. In this case, the ball touching the lane border would be interpreted by the system as a ball falling in the gutter.
- The sensors 504*a*-504*d* could provide to the pinspotter and the scoring or the management system the information of a foul, i.e. a player stepping on the lane beyond the foul line.

As shown in the exemplary implementation of the systems and processes of FIG. 4, in embodiments, the bumpers are specifically designed to support the above-mentioned illustrative embodiments. For example, the bumpers, whether they are single elements (as shown in FIG. 1) or made by more distinct elements, e.g., 501*a*, 501*b*, 501*c*, 501*d*, have one or more independent sensors 504*a*, 504*b*, 504*c*, 504*d*, along their length. The sensors 504*a*, 504*b*, 504*c*, 504*d* can detect where contact is made on the bumper by a bowling ball. The contact information is relayed to the dedicated bumper control system, to the scoring system or to the management system as described herein. In embodiments, sufficient number of sensors, from one to many, according to the adopted sensor technology, is present in order to be able to break the bumpers into zones of variable lengths, from small (e.g., a meter or less) to larger (e.g., the entire lane). The sensors 504*a*, 504*b*, 504*c*, 504*d* can be, for example, pneumatic, electromechanical, photoelectric, electrical, and image-detection based as further described below. The focus of pneumatic, electromechanical, photoelectric, electrical sensors is to detect the ball touching the bumper rails.

Pneumatic sensors are technologies based on pneumatic tubes that when hit trigger a pressure sensor mounted at the end of the tube. These tubes can be mounted and provide hit detection on bumper segments or on the entire bumper length.

Electromechanical sensors are technologies able to detect the position of the ball hits along the entire bumper or its target segment based on the triangulation of different vibration detecting sensors.

Photoelectric technologies can be used with sensors placed on the bumpers or on their segments along the lane. These technologies are capable of detecting the position of the ball at a given moment, even if the ball does not touch the bumper.

Image-detection based systems, e.g., cameras, can be mounted to face the lane surface. These technologies are capable of mapping the lane, detecting and recording position, trajectory and speed of the bowling ball. Also in this case the ball would not need to touch the bumper to be detected.

Electrical sensors are technologies able to detect the position of the touch in the segment, based on the propagation time of a signal along two conductors that get in contact when the ball hits the bumper or one of its segments. The electrical sensors can be, for example, a micro switch actuated by the deflection of the bumper or a vibration sensor able to pick up the vibration on the bumper or other sensors able to detect the result of the mechanical impact of the ball on the bumper).

FIG. 4 further shows a plurality of lights 503*a*, 503*b*, 503*c*, 503*d* running the length of the bumper that are controllable and connected to the scoring and the game control systems as described herein. Although four lights are shown, the present invention contemplates more or less lights at different locations depending on the particular application. For example, the lights 503*a*, 503*b*, 503*c*, 503*d* can also be placed along the bowling lane 20 at other locations. Also, the lights 503*a*, 503*b*, 503*c*, 503*d* can be representative of a laser-based lighting projection. The lights 503*a*, 503*b*, 503*c*, 503*d* have one or more of the following characteristics.

The lights 503*a*, 503*b*, 503*c*, 503*d* can be used as a targeting signal, e.g., lighting locations with similar or different colors signaling where to hit or not to hit along the bumper length. Lighted locations could match sensor zones. This would allow games based on which bumper section to hit, with related rewards or penalties according to the ball event. Exciters can be connected to one or more of the detection system, scoring system, management system, or other systems connected or unconnected to the bowling center systems. In this way, light routines can be triggered by a scoring event or by other events of the bowling center, e.g., including positions of the bowling ball, hits on the bumper, etc.

The lighting can be used in conjunction with ball position on the lane 20 (e.g. lights follow the ball as it rolls towards the pins, in conjunction with use of the sensors). The lights 503*a*, 503*b*, 503*c*, 503*d* can also have a full range of colors, and can be used to give information on a possible wrong behavior of the bowler, in terms of hitting force of the ball. For example, if it is detected that the bowling ball has been launched with excessive force, with the intended or unintended consequence of damaging the bumpers, all the lights

503*a*, 503*b*, 503*c*, 503*d* could start a red pulsating pattern, to warn the bowler of the incorrect behavior. The same information can be used by the scoring system to assign a penalty. The lights 503*a*, 503*b*, 503*c*, 503*d* can have color changing properties which can be used to identify and signal the contact point of the ball on the bumper. The lights 503*a*, 503*b*, 503*c*, 503*d* can also be integrated on the bumper, mounted on it, but also mounted on the division capping or projected by RGB projectors mounted in a suitable position, among the others on the ceiling. An alternative technology can be a laser-based lighting projection.

Still referring to FIG. 4, the bumper movement is controlled by actuators. By way of example, each bumper segment is controlled by dedicated actuators 502*a*, 502*b*, 502*c* and 502*d*. The actuators 502*a*, 502*b*, 502*c* and 502*d* are connected to and managed by the actuator control unit 520. Moreover, the bumper sensors 504*a*, 504*b*, 504*c*, 504*d* are connected to and managed by the sensor control unit 510. In addition, all light strings 503*a*, 503*b*, 503*c*, 503*d* are connected to and managed by the lights control unit 530. The control units 510, 520 and 530 are connected to the lane processing unit 103 as described, for example, in FIG. 2.

In additional embodiments, the sensors 504*a*-504*b* can detect where the ball is at on the lane even without contacting the bumpers. For example, the "ball-position" detection is performed by a non-contact sensors that can pick up the ball position even when rolling in the lane and not contacting the bumpers, e.g., camera, ultrasound, microwave radar or optical sensor. Specifically, the camera can be used to look on the lane (which may be used with some infrared light to allow the camera to see in the dark). The ultrasound/microwave radar system can pick up the ball position; whereas, an optical sensor detects the ball breaking some light beam which is then used to calculate the ball position. So, in implementation, the ball position can be known even if it does not touch the bumper. This allows for using the ball position to enhance the light effect that can run by the light system, e.g., lights 503*a*, 503*b*, 503*c*, 503*d*. Specifically, in embodiments, the light effect can "follow" the ball while the ball is rolling down the lane. And, when the "bumper-impact" detects the ball touching the bumper, the information from the "ball-position" sensor allow the scoring to detect if the area touched is the good or bad one.

As in each of the embodiments, the sensors 504*a*-504*b* will provide a signal to the electronic control system, which can use the signals to detect a position of the bowling ball as it rolls down the bowling lane. The electronic control system then provides a signal to the lighting system to provide lighting in predetermined arrangements. The predetermined arrangements can be, for example, tracking of the bowling ball, segmenting the bumpers or highlighting another area of the bowling lane.

Figure 5:
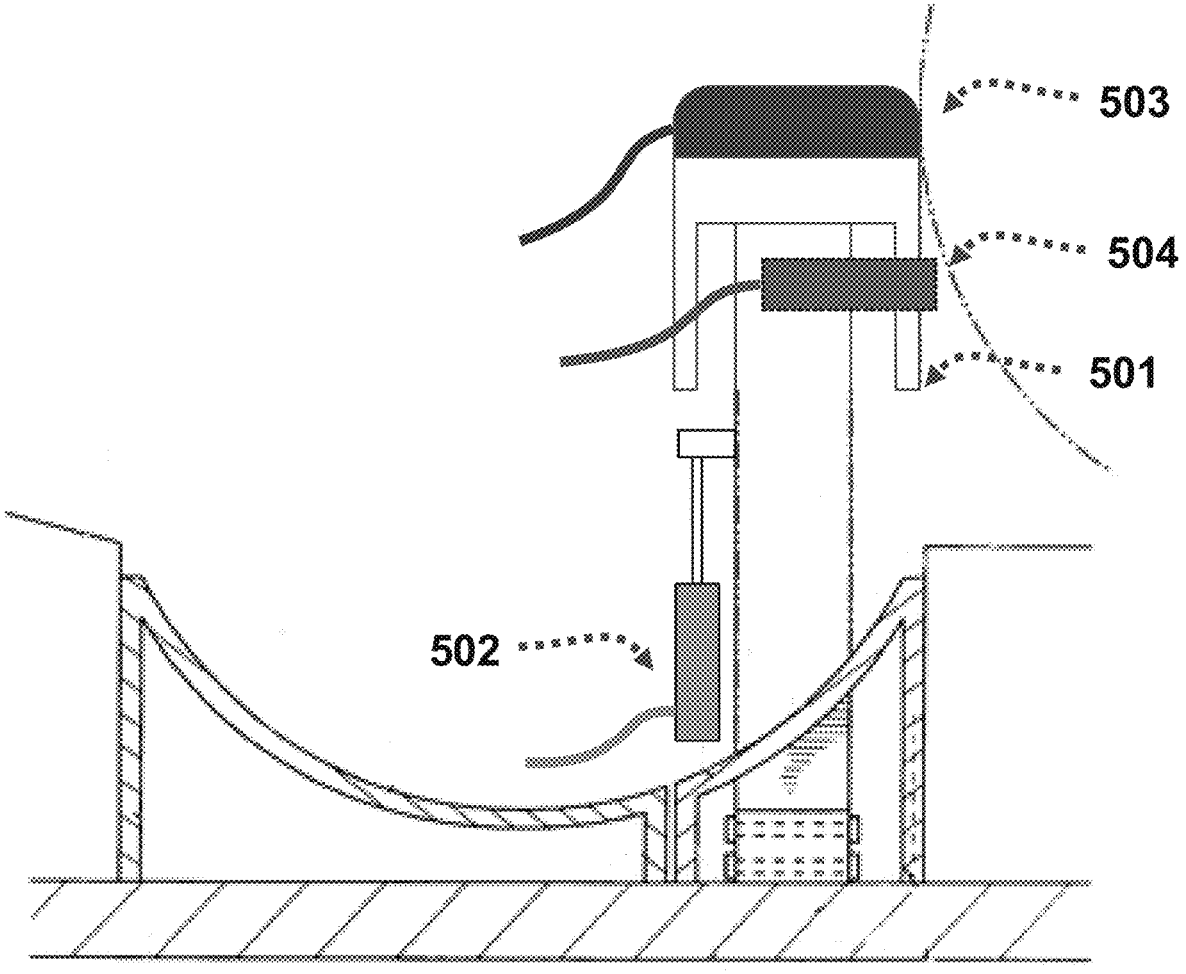
FIG. 5 shows a detailed view of an illustrative implementation of the systems and processes in accordance with aspects of the invention.

FIG. 5 shows a detailed view of an illustrative implementation of the systems and processes in accordance with aspects of the invention. More specifically, FIG. 5 shows a bumper 501, bumper sensors 504 mounted on the bumper 501, lights 503 and an actuator 502 to control the bumper movement and position. In a variant, the bumper 501 can be fixed, and reinforced to be used with standard balls. The bumpers 501 can be either removable, or fixed with the elimination of the gutter on a bowling lane. In embodiments, the fixed bumper with sensors could functionally replace the existing gutter, with the sensors 504 detecting when the ball impact on the bumper, working as an emulation of the ball falling in the gutter. This could be a significant improvement in all contexts where a USBC/BPAA/PBA-regulated bowling lane is not required, and/or the scope of the game is not based on traditional bowling. A lane with a fixed touch-sensitive bumper would have many advantages, function and cost-wise, over a standard lane: the gutter would not be needed the foundation would be lower requiring less building material, the lane width would be lower, allowing more lanes horizontally or a small surface for a given number of lanes.

The sensor detections can be used to provide additional inputs for the scoring. For example, each detection can modify the scoring or a single detection can be used to simulate the ball falling in the gutter. Moreover, sensor detections can be associated with penalties, modifying the traditional bowling score, or a special bowling score in case of special games, or the outcome of bowling game alternative games such as QubicaAMF's "Mad Games" where the outcome is not a bowling score but a dynamically created image (e.g., Character or Monster Factory) or a ranking (Bowlin 'Hood).

Contacts can also or alternatively be associated with additional penalties or rewards, independent from the bowling game score, such as inputs for a redemption game using redemption system 500 shown in FIG. 2. For example, rewards or penalties can be associated with single detections, sequences of detections, detections or detection sequences in determined bumper zones (e.g. the player must hit the bumper only in the green-lighted area, avoiding the ball to bounce and hit the red-lighted area on the opposite side of the bumper. The bumper zone involved in such games could be determined by the scoring or management system as part of predefined games or routines, or could be preselected by the players, or can be determined by a combination of both (e.g. the player chooses a particularly difficult bumper zone to hit because if the player succeeds the player will obtain a higher score). The bumper zones could be fixed and stable along all the time the player is allowed to throw a ball, or could change according to a fixed or a casual pattern, increasing the game difficulty.

A scoring system is not necessarily needed for a center using the new game concept. The system could work in a standalone mode, with sensors and lights connected to a dedicated non-scoring processing unit (represented in FIGS. 2 and 3), receiving inputs from the sensors, processing them according to a predefined instruction set (either preset by the manufacturer or customizable by the customer) and sending out inputs accordingly. Such set up could involve bumper lights reacting to bumper sensor detections, with or without a game meaning. The game could also be played without any automatic system in place, with the bowlers playing on a lane with raised bumpers, using the bumpers as an active part of the game, but keeping their score manually according to predefined game rules involving bumpers as an active game element (e.g. if the player scores a strike having hit the central section of the right-hand bumper, than the strike counts twice).

In further embodiments, the detection system processing unit and/or the bumper lighting system described herein, or the individual sensors and lights with no interface, could be connected to the scoring system, allowing a full interaction between the two systems, with the inputs coming from the sensors (e.g., sensor 504) accounted for by the system and treated as other scoring inputs, that combined with other scoring events can determine the scoring or the outcome of a game managed by the system. The scoring system could then instruct the light-sensor processing unit, or directly the lights, to act according to predetermined or real-time processed instructions to obtain specific effects on the lanes. The bumper's light can be made to act together with other special effects present at the center, such as to obtain coordinated light effects on the lanes or throughout the center. The scoring system can be represented by any of the computing devices shown in FIGS. 2 and 3, for example.

Additional options are also contemplated by the present invention. For example, the players could use bowling balls lighter than the standard ones, allowing for more possibilities such as more rebounds for given throwing force. The lane could be equipped with lighter, non-standard pins, allowing an easier scoring with a lighter ball, or in case of many rebounds on the bumpers. Moreover, the bowling ball could be equipped with an internal RGB or non-RGB lighting source, with predetermined lighting patterns, or with lighting effects that can be triggered by specific events, such as when a determined bumper zone, or sequence of zones, is hit. Alternatively, the ball could light up when the pins are hit. The dynamic lighting could be controlled having an internal receiver such as an RFID tag on the ball capable of receiving transmitted input signals coming from the scoring or the management system.

In additional embodiments, the bumpers could be equipped with an active rebounding system, pushing outward and downward on the ball to propel it away in case of bumper-hitting. This can be done with actuators also represented by reference numeral 502, and activated by the sensors detecting a ball strike at certain locations on the bumper 501. Games can be based not only on the two balls turn of traditional bowling game format, e.g. allowing for games with one ball per frame. Games could require the player to throw a ball from a specific position, to have a valid outcome. The position or throw mode could be indicated by the scoring system.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

What is claimed is:

1. A bowling system, comprising:

a plurality non-contact optical sensors which are configured to detect a position of a bowling ball as it is rolling down a bowling lane by emitting a light beam;

a lighting system configured to light predetermined locations within a bowling centre in predetermined arrangements; and an electronic control system which receives signals from the plurality of non-contact optical sensors, determines a position of the bowling ball on the bowling lane and provides signals to the lighting system to light the predetermined locations within the bowling centre in the predetermined arrangements, wherein the plurality of optical non-contact sensors each of which are provided on a side and along a length of the bowling lane and each of which are structured to emit a light beam toward the bowling lane and provide a signal to the electronic control system when the light beam is broken by the bowling ball, and wherein upon the bowling ball breaking the light beam emitted from the plurality of non-contact optical sensors toward the bowling lane of any of the plurality of non-contact optical sensors, the non-contact optical sensor which had its light beam broken provides the signal to the electronic control system which uses the signal to detect a position of the bowling ball as it rolls down the bowling lane.

2. The bowling system of claim 1, wherein the electronic control system provides signals to the lighting system to provide lighting effects tracking the bowling ball as it rolls down the bowling lane.

3. The bowling system of claim 1, wherein the predetermined locations within the bowling centre comprise at least one of the bowling lane, portions of the bowling lane, and adjacent areas linked to the bowling lane.

4. The bowling system of claim 1, wherein the non-contact optical sensors with the electronic control system detect the position of the bowling ball when it contacts bumpers.

5. The bowling system of claim 4, wherein the electronic control system provides signals to the lighting system to provide lighting effects in response to the bowling ball contacting the bumpers.

6. The bowling system of claim 1, further comprising contact sensors provided on bumpers to determine a contact of the bowling ball on the bumpers along sides of the bowling lane, in conjunction with the electronic control system.

7. The bowling system of claim 6, wherein the electronic control system provides signals to the lighting system to provide lighting effects in response to the bowling ball contacting the bumpers.

8. The bowling system of claim 6, wherein the electronic control system provides signals to the lighting system to provide lighting effects in response to the bowling ball contacting the bumpers at the position determined by the plurality of the non-contact optical sensors.

9. The bowling system of claim 1, wherein the electronic control system provides signals to the lighting system to segment bumpers into a plurality of bumper segments.

10. The bowling system of claim 1, wherein the lighting system is provided on the bumpers along sides of the bowling lane.

11. The bowling system of claim 1, wherein the bumpers are provided on sides of the bowling lane, and the bumpers are segmented into the plurality of different bumpers on each side of the bowling lane by the lighting.

12. The bowling system of claim 1, further comprising bumpers on sides of the bowling lane and an active rebounding system in which the bowling ball, as it hits the bumpers, is rebounded therefrom.

13. A bowling system, comprising:

a plurality of non-contact optical sensors which are configured to emit a light beam, the plurality of non-contact optical sensors are arranged along a length of a bowling lane and which are structured to track a position of a bowling ball as it is rolling down the bowling lane when its emitted light beam is broken by the bowling ball;

a lighting system configured to light the bowling lane in predetermined arrangements tracking the bowling ball as it rolls down the bowling lane, as the bowling ball is tracked by the one or more non-contact optical sensors as its light beam is broken by the bowling ball; and an electronic control system which receives signals from the plurality of non-contact optical sensors, determines a position of the bowling ball on the bowling lane and provides signals to a lighting system control which controls to the lighting system to light the bowling lane as the bowling ball is tracked by the bowling ball breaking the light beam of the plurality of non-contact optical sensors, wherein the plurality of non-contact optical sensors are provided on a side and along a length of the bowling lane and each of which are structured to emit the light beam toward the bowling lane and based on the break of the light beam, provide a signal to the electronic control system which uses the signal associated with breaking of the at least one light beam as detected by any of the plurality of non-contact optical sensors to detect a position of the bowling ball.

14. The bowling system of claim 13, further comprising contact sensors provided on bumpers to determine a contact location of the bowling ball on the bumpers along sides of the bowling lane, in conjunction with the electronic control system.

15. The bowling system of claim 13, further comprising an active rebounding system in which the bowling ball, as it hits the bumpers on sides of the bowling lane, can be rebounded therefrom.

16. The bowling system of claim 13, wherein the electronic control system provides signals to the lighting system to provide lighting effects in response to the bowling ball contacting the bumpers at the position determined by the one or more non-contact optical sensors.

17. The bowling system of claim 13, wherein the electronic control system provides signals to the lighting system to provide lighting effects tracking the bowling ball.

18. The bowling system of claim 1, wherein the electronic control system controls the lighting system to target certain sections of bumpers prior to any impact.

19. The bowling system of claim 18, wherein lights of the lighting system run the length of the bumpers, which are controllable and connected to the electronic control system which comprises scoring and game controllers.

20. The bowling system of claim 18, wherein each zone includes a sensor.

21. The bowling system of claim 18, wherein a single bumper-long sensor extends over plurality of the zones.

22. The bowling system of claim 18, wherein the lighting system comprises a plurality of lights running the length of the bumpers that are controllable and connected to the electronic control system which comprises scoring and the game control systems.

23. The bowling system of claim 20, wherein the lights are targeting signals of similar or different colors where to hit or not to hit along a length of the bumpers and the lights are used to give information on a possible wrong behavior of the bowler in terms of hitting force of the ball.

24. The bowling system of claim 1, wherein the lighting system runs the length of the bumpers and are controllable by the electronic control system which provides signals to the lighting system to provide lighting effects in response to the bowling ball contacting the bumpers at the position determined by the one or more non-contact optical sensors.

25. The bowling system of claim 13, wherein the lighting system runs the length of the bumpers, which are controllable by the electronic control system which provides signals to the lighting system to provide lighting effects in response to the bowling ball contacting the bumpers at the position determined by the one or more non-contact optical sensors.

* * * * *